United States Patent [19]

Neff

[11] 4,359,226

[45] Nov. 16, 1982

[54] BOARD GAME WITH INTERRELATED CARDS AND CHIPS

[76] Inventor: Robert A. Neff, 5767 Sebring Dr., Indianapolis, Ind. 46254

[21] Appl. No.: 143,744

[22] Filed: Apr. 25, 1980

[51] Int. Cl.[3] ..... A63F 3/00

[52] U.S. Cl. ..... 273/243; 273/256

[58] Field of Search ..... 273/256, 243, 248, 249

[56] References Cited

U.S. PATENT DOCUMENTS

| | | | |
|---|---|---|---|
| 3,737,167 | 6/1973 | Kelley | 273/243 |
| 4,013,294 | 3/1977 | Smeda et al. | 273/243 |
| 4,121,823 | 10/1978 | McBride | 273/243 X |
| 4,136,881 | 1/1979 | Anspach | 273/256 |
| 4,216,971 | 8/1980 | Lyke | 273/243 |

FOREIGN PATENT DOCUMENTS

| | | | |
|---|---|---|---|
| 566158 | 7/1975 | Switzerland | 273/243 |
| 801964 | 9/1958 | United Kingdom | 273/243 |

*Primary Examiner*—Richard C. Pinkham
*Assistant Examiner*—Scott Brown
*Attorney, Agent, or Firm*—Jenkins, Coffey, Hyland, Badger & Conard

[57] ABSTRACT

A game embodies the celestial concept of Karma and the repayment in future lives for deeds done in past lives. The game has a board around which are playing positions and an inner register for indicating the number of revolutions around the board. At various locations along the board, a player will be instructed to pick up either a Good or Bad Karma card, a Good Karma card causing a player to have an immediate disadvantage but a long-term advantage, and a Bad Karma card causing an immediate advantage but a long-term disadvantage. A player will be instructed to pick up a Good Payback card which causes him to exchange long-term advantage for immediate advantage, or a Bad Payback card which causes him to exchange long-term disadvantage for immediate disadvantage. A barrier system halts a player's travel around the board and forces him to return to a prior position unless a certain condition, illustratively, the payment of money, is met and permits, with a random number generator having a controlled probability of number generation, such as a pair of dice, the controlled but random interaction of a player and the Karma and Payback cards.

11 Claims, 1 Drawing Figure

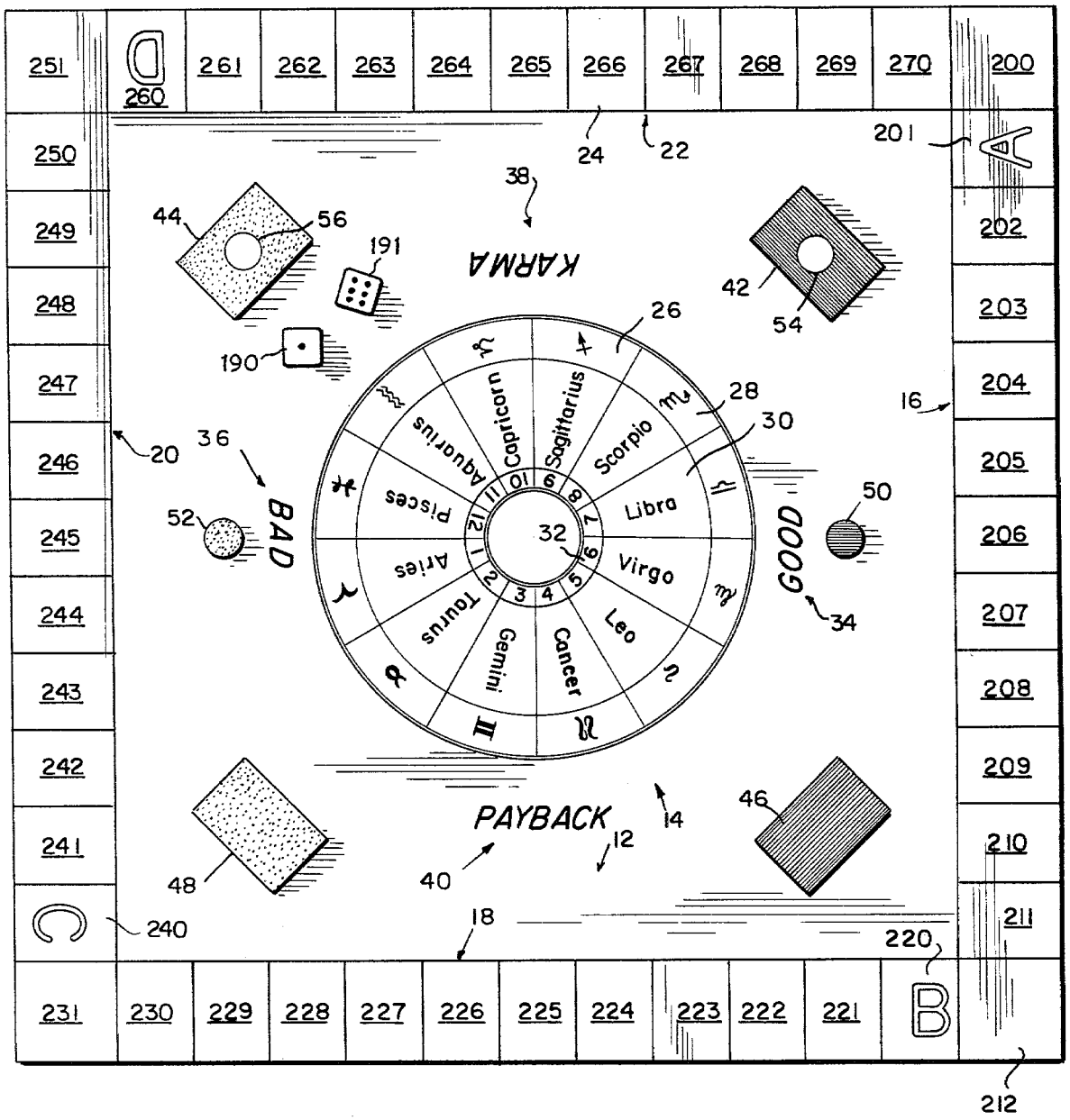
KARMA
PAYBACK
BAD
GOOD
Capricorn
Sagittarius
Scorpio
Libra
Virgo
Leo
Cancer
Gemini
Taurus
Aries
Pisces
Aquarius
A
B
C
D
12
14
16
18
20
22
24
26
28
30
32
34
36
38
40
42
44
46
48
50
52
54
56
190
191
200
201
202
203
204
205
206
207
208
209
210
211
212
220
221
222
223
224
225
226
227
228
229
230
231
240
241
242
243
244
245
246
247
248
249
250
251
260
261
262
263
264
265
266
267
268
269
270

BOARD GAME WITH INTERRELATED CARDS AND CHIPS

This invention relates to a game for the entertainment of two or more players that may teach the concepts of Karma.

The game involves a race among players to achieve a long-range goal and requires the achievement of short-term goals. In the game a player may expedite the achievement of short-term goals but at the expense of the achievement of the long-range goal. The player finds himself in this dilemma often in the game, and the preferred embodiment of the game is designed so that the players must exercise their judgment frequently while confronted with such a dilemma. These features of the game may be incorporated into a board game, but may be enjoyed without the use of a board through tally sheets or other such means to record the progress of the game.

In the game, players must make choices in which a medium of exchange, such as currency or any other counting means, is accumulated which will expedite the completion of short-term goals but only with an accompanying collection of counters which are inconsistent with the long-range goal of the game. Also, players may be forced to make counter Payback choices between either (1) the disposal of counters that are inconsistent with the long-range goal by the expenditure of medium of exchange, thereby delaying the player's completion of short-term goals, or (2) the further accumulation of medium of exchange to expedite the completion of short-term goals, by the expenditure of other counters that may provide an advantage with respect to the long-range goal. In addition, the game may include one or more barriers past which a player may not proceed unless certain conditions are met; and if the conditions are not met, the player must return to a preceding state or position.

Where the game is played on a board, each player will have a marker; and movement of the marker is determined by a controlled probability random number generator, such as a set of dice or a spinner with different arc lengths for the numbers. The board may include positions, over which the marker is moved and upon which the marker may come to rest, that require a player to choose between a card from a first deck or second deck of cards. The first deck of cards includes instructions which cause a player to have a short-term disadvantage but a long-range advantage, and the second deck of cards includes instructions which cause a player to have a short-term advantage but long-range disadvantage. Further, the board can include a space upon which a player's marker may come to rest that causes a player to choose between a card from a third deck or fourth deck. The third deck of cards includes instructions which cause a player to exchange long-range disadvantage at the expense of a short-term disadvantage, and the fourth deck of cards includes instructions which cause a player to exchange long-range advantage for short-term advantage. For example, long-range disadvantage may be bad future counters which must be disposed of after the player completes his short-term goals. Long-range advantage may be good future counters that are useful in offsetting the long-range disadvantage or in completing short-term goals. The short-term advantage may be a medium of exchange, such as play money or any other counting means, a certain amount of which is required to pass barrier positions on the board in the achievement of the short-term goals.

The game of this invention may be associated with the concepts of Karma in a board game. Karma has been defined as the whole ethical consequence of one's acts considered as fixing one's lot in future existence. The short-term goals of the game may be related to life in the material world through which the player must pass one or more times to win the game. The material world may be represented by a closed circuit of adjacent spaces on the board. Achievement of the short-term goals, passage through life in the material world and around the closed circuit, is expedited by the accumulation and expenditure of the medium of exchange such as currency. Currency may be accumulated during the play of the game in response to instructions from the spaces of closed circuit on which the player's marker comes to rest. The game may also include a number of barrier spaces at which the player's marker must stop and from which the player may not proceed unless he is able to pay a certain amount of currency from his accumulation. The inability of the player to pay the required amount of currency requires the return of his marker to a prior space, delaying completion of the short-term goals. A number of the closed circuit spaces on which the player's marker may come to rest may be Karma spaces in which the player is forced to elect between the selection of a card from either a Good Karma set or a Bad Karma set. Selection of a card from the Bad Karma set requires the player to take a Bad Karma chip (a bad future counter) but provides the player with additional currency or an additional turn to assist the player in completing the short-term goals of travel around the closed circuit. Selection of a Good Karma card results in an accumulation of a Good Karma chip (a good future counter) but requires the player to expend currency or lose a turn, thereby delaying the completion of the short-term goals of traversing the closed circuit. The barrier spaces and designated prior spaces, or return spaces, in combination with a known probability random number generator, such as dice, permit the location of Karma spaces with respect to the designated return spaces where the Karma spaces are most probably hit as a player moves from the designated return space. This combination of features in the game results in the player being required to make many decisions between the completion of short-term goals at the expense of the long-range goal or vice versa.

The game involving the concepts of Karma can thus include currency as a medium of exchange, a set of dice, a marker or token for each person, a board having a closed circuit made up of a plurality of adjacent spaces arranged seriatim to represent life in the material world, with the circuit being divided into two or more sections, each representing a span of life and including a portion of the spaces and ending with a barrier space. A number of Good Karma chips and a number of Bad Karma chips are provided to assist in measuring the completion of the long-range goal of the game, and two sets of Karma collection cards are provided for use during the course of the game: one of the sets being labeled as Bad Karma cards and including instructions providing income in currency and additional turns to a player but requiring the player to receive a Bad Karma chip, and the other set being designated as Good Karma cards including instructions requiring expenditure of currency and loss of turns by the player but providing Good Karma chips. The barrier space at the end of each section of the closed circuit prevents passage of the marker of any player who does not have the required amount of currency and requires a return of the player's marker to a prior space, which may be a return space at the beginning of that life-span section. Each life-span section can include a Karma space requiring a player whose marker lands thereon to choose between a card from either the set of Good Karma cards or from the set of Bad Karma cards.

The game may be played by a process in which each player in turn throws the dice and moves his marker, from space to space on the closed circuit, the number of spaces corresponding to the number on the dice after each throw. The player follows the instructions on the space where his token comes to rest and, if this space is a Karma space, makes a choice between the selection of a Good Karma card or a Bad Karma card. The player receives or loses currency and turns and Good and Bad Karma chips in compliance with the instructions provided on the space or as provided on the Good and Bad Karma cards. The player's marker stops at each barrier space, and the player must pay the amount of currency required at each barrier, if possible, before the player's next turn; and if the player cannot pay, the player returns his marker to the return space at the beginning of the life-span section.

The Karma game involves a race between players to complete a number of transits of the closed circuit, representing lifetimes in the material world, and thereafter to dispose of all the Bad Karma chips collected during those transits. During the course of the Karma Game, each player is thus required to elect, in his judgment, between the accumulation of currency in the material world at the expense of accumulating Bad Karma that must be disposed of after the lifetimes in the material world.

The unique features of this game particularly suit themselves to instruction in the concepts of Karma but may be provided with other themes and provide entertainment through the use of the games' concepts in forcing a player to frequently make elections that compromise achievement of a long-range goal with short-term success and that compromise short-term success with long-range failure.

The invention may be understood by reference to the accompanying drawing and following description of the game as a Karma board game.

In the drawings:

FIG. 1 is an overhead view of a game board characteristic of this invention.

THE EQUIPMENT

Referring now to FIG. 1, a game board 10 has an outer closed circuit 12 which represents the material world and an inner register 14 which represents the Karmic wheel. The closed circuit 12 is divided into four life-span sections, one along each side of the square-shaped board 10. Life-span section 16, on the right as viewed from FIG. 1, represents childhood. Continuing clockwise, life-span section 18 represents youth; life-span section 20 represents middle age; and life-span section 22 represents old age. The closed circuit 12 and each life-span section 16–22 is divided into a plurality of spaces 24. Illustratively, each life-span section includes 12 spaces.

The register 14, or Karmic wheel, is divided into twelve sections 26. Each section 26 contains a symbol 28 and name 30 describing an astrological house. A number 32 designates the order of use in recording the circuits made by each player on the outer circuit (and the order in which the astrological houses ascend above the horizon).

Two qualities, "Good" 34 and "Bad" 36, appear on the board as do two concepts, "Karma" 38 and "Payback" 40. Four decks of cards appear on the board. Specifically, the corner in between Good 34 and Karma 38 has a stack of Good Karma cards 42. The corner in between Bad 36 and Karma 38 has a stack of Bad Karma cards 44. The corner in between Bad 36 and Payback 40 has a stack of Bad Payback cards 48. The corner in between Good 34 and Payback 40 has a stack of Good Payback cards 46. A stack of Good Karma chips 50 appears on the right side of playing board 10 and a stack of Bad Karma chips 52 appears on the left side of board 10. A circle 54 appears on the back of Good Karma cards 42 and a circle 56 appears on the back of Bad Karma cards 44. The purpose of these circles 54, 56 is to locate, respectively, a Good Karma chip and a Bad Karma chip and to remind a player to take a Good Karma chip 50 or Bad Karma chip 52, respectively, when a Good Karma card 42 or a Bad Karma card 44 is withdrawn from the pile. Illustratively, to further aid the players, Good Karma cards 42, Good Payback cards 46, and Good Karma chips 50 are all blue; and Bad Karma cards 44, Bad Payback cards 48, and Bad Karma chips 52 are all crimson.

THE MATERIAL WORLD

Illustratively, the spaces of closed circuit 12 may be marked with the following inscriptions:

Childhood

200—BIRTH/DEATH

201—A

202—AT BIRTH, UNCLE RALPH GAVE YOU $80

203—FOR ONE YEAR'S SALARY FOR DELIVERING PAPERS COLLECT $50

204—RECEIVE ONE YEAR'S ALLOWANCE IN ADVANCE: COLLECT $50

205—COLLECT $30 IN TIPS WAITING ON TABLES

206—YOU HAVE EARNED $30 STOMPING GARBAGE AT THE DUMP

207—PAYBACK

208—KARMA

209—COLLECT $40 FROM THE IRS AFTER FILING YOUR W-2 FORM

210—PAYBACK

211—KARMA

212—PAY $100 OR RETURN TO SQUARE "A"

Youth

220—B

221—UNCLE RALPH GAVE YOU $400 FOR GRADUATION

222—RECEIVE A $300 FEE FOR PSYCHOANALYZING HOUSE PLANTS

223—YOU HAVE EARNED A $100 COMMISSION SELLING VACUUM CLEANERS DOOR TO DOOR

224—COLLECT $200 CONSULTANT'S FEE FROM CHEWING GUM MANUFACTURER

225—THE SALE OF YOUR BEER CAN COLLECTION BRINGS IN $200

226—PAYBACK

227—KARMA

228—COLLECT $200 STUD FEE (FOR SERVICES RENDERED BY FIDO)
229—PAYBACK
230—KARMA
231—PAY $500 OR RETURN TO SQUARE "B"
Middle Age
240—C
241—UNCLE RALPH DIED AND LEFT YOU $900
242—YOUR RARE, ANTIQUE CHAMBER POT BRINGS IN $600 AT AUCTION
243—COLLECT $200 INTEREST FROM YOUR SAVINGS ACCOUNT
244—THE STOCK MARKET GOES UP—YOU GET $300
245—ROYALTIES FROM YOUR NOVEL PAY YOU $300
246—PAYBACK
247—KARMA
248—COLLECT A $400 DIVIDEND FROM YOUR GARBAGE STOMPING OPERATION AT THE DUMP
249—KARMA
250—PAYBACK
251—PAY $1,000 OR RETURN TO SQUARE "C"
Old Age
260—D
261—UNCLE RALPH HAS BEEN REINCARNATED AND HE WANTS HIS MONEY BACK—GIVE HIM $50.
262—PAYBACK
263—YOU'VE GONE FISHING—LOSE ONE TURN
264—KARMA
265—UNCLE RALPH IS NOT SATISFIED WITH $50—SEE WHAT YOU CAN DO
266—PAYBACK
267—KARMA
268—GO AHEAD, TAKE ANOTHER TURN—P.S. GOODBYE
269—RETURN TO SQUARE "D"
270—RETURN TO SQUARE "D"

Currency collected by a player in accordance with the instructions of the spaces of the outer circuit 12 is taken from the Bank. Currency paid in accordance with the instructions of spaces 261 and 265 may be placed in Uncle Ralph's Trust Fund (described below) under the preferred rules of the game.

In the game, players at various times will remove cards from the board and follow the instructions on the face of the card. The instructions which appear on the face of each card reflect the quality and concept of the corner from which the card is taken.

GOOD KARMA

Illustratively, Good Karma cards 42 may have the following instructions:

100—YOU LIKE UNCLE RALPH SO MUCH THAT YOU HAVE GIVEN ALL YOUR MONEY TO HIS TRUST FUND.
101—PEACE IS MORE THAN JUST A WORD TO YOU. GIVE ALL YOUR MONEY AND YOUR NEXT 3 MOVES TO THE PLAYER WHO YOU THINK NEEDS IT THE MOST.
102—IF THERE IS SOMEONE BEHIND YOU ON THE MATERIAL BOARD, EXCHANGE PLACES AND GIVE THEM ALL YOUR MONEY.
103—GIVE HALF YOUR MONEY TO UNCLE RALPH'S TRUST FUND. (THANK YOU)
104—GIVE HALF YOUR MONEY TO UNCLE RALPH'S TRUST FUND.
105—PICK UP A GOOD PAYBACK AND GIVE THE PROCEEDS TO THE PLAYER OF YOUR CHOICE. (KEEP YOUR BLUE CHIP)
106—GIVE ALL YOUR MONEY TO UNCLE RALPH'S TRUST FUND.
107—YOU HAVE DECIDED TO GIVE UP YOUR TURNS FOR THE TIME REQUIRED TO GET REFRESHMENTS FOR THE OTHER PLAYERS.
108—GIVE FIVE HUNDRED DOLLARS TO THE POOREST PLAYER (OTHER THAN YOURSELF).
109—THE QUALITY OF MERCY IS NOT STRAINED. GIVE ALL YOUR MONEY AND YOUR NEXT TWO MOVES TO THE PLAYER FARTHEST BEHIND.
110—GIVE HALF YOUR MONEY TO THE POOREST PLAYER.
111—GIVE UP YOUR NEXT TURN SO THAT OTHERS MAY ADVANCE.
112—GIVE YOUR NEXT TURN TO THE PLAYER OF YOUR CHOICE.

Thus, selection of a Good Karma card results in a player having a Good Karma chip, a good future counter providing a long-range advantage, but exposes the player to instructions providing a short-term disadvantage.

BAD KARMA

Bad Karma cards 44 may illustratively bear the following instructions:

140—EMBEZZLE $200 FROM YOUR FATHER'S COMPANY.
141—COLLECT $300 FOR STOCK FRAUD.
142—KIDNAP THE PLAYER OF YOUR CHOICE AND COLLECT A $200 RANSOM.
143—PANDERING ON THE STREET CORNER YIELDS YOU $70.
144—EXTORT $30 FROM THE POOREST PLAYER IN THE GAME BY USING THE "PROTECTION" RACKET. 145—RECEIVE $20 FOR THE SALE OF STOLEN HUBCAPS.
146—YOU HAVE CHEATED ON YOUR TAXES. COLLECT $500.
147—YOU LIED TO A FRIEND IN A BUSINESS DEAL. TAKE EVERYTHING FROM THE PLAYER OF YOUR CHOICE.
148—STICK UP THE PLAYER OR YOUR CHOICE FOR AS MUCH AS YOU CAN GET.
149—STICK UP THE BANK AND COLLECT $100. THEN TAKE ANOTHER TURH TO GET AWAY.
150—YOU MUGGED AN OLD LADY AND SNATCHED HER PURSE. YOU GOT $30.
151—FORECLOSE ON A MORTGAGE. TAKE ALL HOLDINGS FROM THE POOREST PLAYER.
152—COLLECT $20 FROM EACH PLAYER FOR THE SALE OF PHONEY INSURANCE POLICIES.
153—THE SALE OF STOLEN PROPERTY BRINGS YOU $50.
154—STEAL ALL MONEY FROM THE RICHEST PERSON IN THE GAME.

Thus, selection of a Bad Karma card results in a player having a Bad Karma chip, a bad future counter providing a long-range disadvantage, but provides the player with a short-term advantage.

GOOD PAYBACK

Similarly, Good Payback cards 46 may illustratively bear the following instructions:

120—CONGRATULATIONS! YOU DIED UNEXPECTEDLY. ADVANCE YOUR MATERIAL PIECE TO THE BIRTH/DEATH SQUARE.

121—IN GIVING TO OTHERS, YOU HAVE SEEN YOURSELF. ADVANCE TO THE NEAREST CORNER FREE OF CHARGE.

122—ADVANCE TO THE NEXT CORNER FREE OF CHARGE.

123—COLLECT UNCLE RALPH'S TRUST FUND.

124—YOU WON THE STATE LOTTERY. COLLECT $250.

125—THE OTHER PLAYERS HAVE DECIDED TO GIVE YOU AN EXTRA TURN.

126—COLLECT $100 FROM UNCLE RALPH'S TRUST FUND.

127—YOU WON THE LOTTERY. COLLECT $250 FROM THE BANK.

128—IN SUFFERING FOR OTHERS, YOU HAVE COME TO HAVE COMPASSION FOR THOSE YOU HATE. EXCHANGE MATERIAL PLACES WITH THE MOST ADVANCED PLAYER.

129—ADVANCE TO THE NEXT CORNER FREE OF CHARGE.

130—THE BANK HIRES YOU AS A SPECIAL CONSULTANT—COLLECT $500.

131—IN GIVING OF YOURSELF, YOU HAVE LEARNED A VALUABLE KARMIC LESSON. MOVE YOUR ASTRAL PIECE AHEAD BY ONE HOUSE.

132—YOU HAVE WON THE MISTER NICE GUY AWARD. THIS GIVES YOU $100.

Thus, the selection of Good Payback cards permits a player to exchange a Good Karma chip for an immediate short-term advantage.

BAD PAYBACK

Finally, Bad Payback cards 48 may illustratively bear the following instructions:

160—FREQUENT SELF-NEGLECT HAS RESULTED IN INSANITY AND COMMITMENT. LOSE TWO TURNS AND $50.

161—YOUR LOAN AT THE BANK HAS EXPIRED. PAY THE BANK $100 PLUS $10 INTEREST.

162—YOUR ARE ON VACATION AND LOSE YOUR WALLET WITH ALL YOUR MONEY. WHAT WILL YOU DO? WHAT WILL YOU DO?

163—YOU HAVE LOST HEAVILY IN GAMBLING. GIVE HALF YOUR MONEY TO THE RICHEST PLAYER.

164—YOU LOST YOUR BRIEFCASE CONTAINING ALL YOUR MONEY. GIVE YOUR MONEY TO THE PLAYER OF YOUR CHOICE.

165—SUDDEN ILLNESS COSTS YOU $500.

166—YOUR BUSINESS HAS BEEN NATIONALIZED. DIVIDE ALL YOUR MONEY BETWEEN THE OTHER PLAYERS.

167—YOU HAVE BEEN CONVICTED OF TAX EVASION. PAY $100 TO THE BANK.

168—THE POOREST PERSON IN THE GAME HAS SUED YOU. YOU SETTLE OUT OF COURT FOR $40.

169—THE POOREST PLAYER IN THE GAME (OTHER THAN YOURSELF) HAS RECEIVED A JUDGMENT AGAINST YOU FOR $100.

170—YOU HAVE BEEN CONVICTED OF ROBBERY. GIVE ALL YOUR MONEY TO THE BANK AND SIT OUT YOUR NEXT TURN.

171—YOU HAVE BEEN SUED FOR ALL YOU ARE WORTH. GIVE ALL YOUR MONEY TO THE PERSON FARTHEST BEHIND (EXCEPT YOURSELF).

172—YOU HAVE BEEN CONVICTED OF CHILD MOLESTING. LOSE THREE TURNS.

173—YOU TRIPPED OVER A ROLLER SKATE AND SPRAINED YOUR ANKLE—LOSE ONE TURN.

174—YOU HAVE BEEN CAUGHT SHOPLIFTING. LOSE TWO TURNS.

Bad Payback permits a player to dispose of a Bad Karma chip and its attendant long-range disadvantage but results in the short-term disadvantage of loss of currency and turns.

THE PLAY

Each player has two identical markers, or tokens. At the beginning of the game, each player will place one of his markers, referred to as his "astral piece", in "Aries", the first house, and the other marker, referred to as his "material piece" will be placed on the Birth/Death space 200.

After determining the sequence of play, a player will roll two dice 190 and 191 and, starting on the Birth/Death square 200, move the number of spaces indicated by a roll of two dice. The player follows the instructions on the space on which his material piece, or marker, comes to rest. The players take turns, except when instructed to the contrary by the Karma cards or Payback cards.

In moving around the closed circuit 12, or material world, if a player lands on a space marked "KARMA", as for instance, space 208, the player must pick up either a Good Karma card (blue) or a Bad Karma card (crimson) and follow the instructions on the card. In picking a Karma card, the player must also take a Good Karma chip or a Bad Karma chip of the same color. It is suggested that each time a player takes a Karma card, he place an appropriately colored Karma chip on top of the stack to remind the next player to take a chip. All of the Karma chips a player accumulates during the current revolution around the outer closed circuit 12 are kept in a "this lifetime" pile. All of the Karma chips accumulated during previous transits of the closed circuit 12 (the material world) may be kept in a "past lifetimes" pile. In the preferred version of the game, each time a person reaches the Birth/Death square 200, he will move all of his "this lifetime" chips to the "past lifetimes" pile.

If a player lands on a Payback square, as for instance, square 210, the player must pick up either a Good Payback card or a Bad Payback card, but only if he has an appropriate Karma chip in his "past lifetimes" pile. If the player takes a Bad Payback card 48, he will take a Bad Karma chip from his "past lifetimes" pile and place it with the other Bad Karma chips 52 on board 10. If the player takes a Good Payback card 46, the player will take a Good Karma chip from his "past lifetimes" pile and place it with the other Good Karma chips 50 on board 10. If a player has exclusively either Good Karma chips or Bad Karma chips in his "past lifetimes" pile, then he must pick up either a Good Payback card or a Bad Payback card, respectively. In the preferred version of the game, a player may not use chips from his "this lifetime" pile.

The PAYBACK square and the accumulation of Good Karma chips through prior selection of Good Karma cards permits a player to prevent the loss of currency through instructions to himself and other players as, for example, may occur in his own selection of Good Karma card 108 or another player's selection of Bad Karma card 151. The player can thus spend any excess currency on a Good Karma chip and gamble on landing on a Payback space at a later time and cashing in his Good Karma chip for currency as, for example, may be received in drawing Good Payback card 127.

Of course, a player can dispose of Bad Karma chips during the game by accepting the instructions of the Bad Payback cards.

Since two dice are being rolled, it is impossible to roll the number one, thus making it impossible to land on squares 201, 220, 240, and 260 except as follows. As the player proceeds clockwise around the closed circuit 12, if a roll of dice would take a player past a corner square 200, 212, 231, or 251, the player will stop at the corner square, regardless of the actual value of his roll, and follow its instructions. If, for instance, a player in his last turn had landed on square 210 and had this time rolled an eight, he would proceed only to square 212 and would not go to square 225. Each of three corner squares 212, 231, and 251 requires the player to pay a specified sum of currency to the bank or return to the prior square A, B, or C, spaces 201, 220, and 240, respectively. Spaces in Section 22 (for example spaces 269 and 270) may include instruction requiring a player to return to space 260. No money is required to stay at the Birth/Death square 200. In moving around the outer board, a player will eventually make a complete circle and return to the Birth/Death square 200. At this point, he dies and is reborn. In this process, the player will forfeit all his money to the bank and will advance his astral piece one space on the inner register, or Karmic wheel.

As an example of the play of this game, the first player, in rolling the dice, may roll a six and move his marker to space 206 and receive $30 from the bank, and his turn would end. The second player, in rolling the dice, may obtain a two. The second player moves his marker to space 202 and, in accordance with its instructions, receives $80 from the bank. The first player then, for example, may roll a ten but may only advance his marker to section 212 at which he stops. The instructions on 212 are for the player to pay $100 or return to square A. Since the first player does not have $100, he places his marker on square A and his turn ends. The second player then rolls a seven and moves his marker to space 209. In accordance with the instructions on space 209, the second player collects $40 from the bank. The first player then rolls, for example, a seven; his marker comes to rest on space 208, a Karma space. The first player must now choose beween the selection of a Good Karma card or a Bad Karma card. Since the first player has only $30 and is faced with the prospect of trying to pass space 212, he, for the purposes of this example, will choose a Bad Karma card from deck 44 and take a Bad Karma chip 56 from the top of the deck. As a convenience in the game, he places a Bad Karma chip from pile 52 onto the next card of deck 44. If, for example, the first player has received card 140, "Embezzle $200 from your father's company," he receives $200 from the bank and his turn ends. On the second player's next turn, he rolls a nine and moves his marker from space 209 to space 212. Since the second player has $120, he puts $100 into the bank (or into Uncle Ralph's Trust Fund which, under certain rules, may be an accumulation of money to be received by a player in any turn, for example, in response to a Good Payback card 123); and the second player's marker remains on space 212. The first player then rolls a six and moves his marker to space 212. Since he has $230, he pays $100 into the bank of Uncle Ralph's Trust Fund in accordance with the rules of the game. Both players, in this sequence of turns, are now in a position to proceed from space 212. The second player rolls an eight and moves his marker to space 227, a Karma space. The second player must now choose between the selection of a Good Karma card or a Bad Karma card; and for the purposes of this illustration, preferring not to collect a Bad Karma chip, the player selects a Good Karma card from deck 42, collecting a Good Karma chip 54. Again, for the convenience of the game, the second player replaces a good Karma chip from stack 150 on the card on top of deck 42. Assuming for the purposes of this illustration that the second player has selected card 105, the second player follows the instructions of card 105 and picks up a Good Payback card from stack 46, for example card 124, collects $250 from the bank in accordance with the instructions on the Good Payback Card 124 and gives the $250 to the first player as instructed on card 105. The second player's turn comes to an end. The first player then rolls a seven and moves his marker to space 226, a Payback space. Assuming the first player has a Bad Karma chip in his "past lifetimes" pile and $380, he replaces the Bad Karma chip on stack 52 and takes a Bad Payback card from stack 48. If, for example, the card chosen is card 165, the first player, in satisfaction of the instructions to pay $500, pays all the money he has to either the bank or Uncle Ralph's trust fund; and his turn ends. Play thus proceeds throughout the game.

The game is won by the first player who: (1) has moved his astral marker on the register 14 around the complete circle so as to return to the first house, or Aries; (2) has paid back all of the crimson Bad Karma chips accumulated in past lifetimes; (3) reaches the Birth/Death square 201; and (4) has not accumulated any more Bad Karma chips.

Certain additional rules are useful for smooth operation of the game. Unless a player is specifically instructed to give money to, or take money from, another player or "UNCLE RALPH'S TRUST FUND", all transactions will be with the bank.

"UNCLE RALPH" and "UNCLE RALPH'S TRUST FUND" may be equivalent to the bank, but the preferred rules include a separate UNCLE RALPH'S TRUST FUND accumulation.

Under the preferred rules, "UNCLE RALPH'S TRUST FUND" is a separate accumulation of currency to which the players contribute, for example, in accordance with the instructions of spaces 261 and 265 and Good Karma cards 100 and 104. "UNCLE RALPH'S TRUST FUND" can thus provide a currency jackpot which can be obtained by any player, for example, in response to Good Payback card 123. With the exception of corners 212, 231, and 251, if a player is instructed to pay more money than he has, he will pay all that he can and the balance will be ignored. However, on corners 212, 231, and 251, a player must pay the entire sum specified or return to the appropriate prior lettered square. Additionally, in the preferred version of the game, it is against the rules to lend or borrow money.

The barrier space and return space in combination with such a known probability random number generator, such as dice, permit the location of Karma and Payback spaces at locations hit with controllable regularity as a player moves from the return space and, thus, can require the player to make many decisions between the achievement of short-term goals at the expense of the long-term goal or vice versa.

For example, Karma spaces are located seven moves and ten moves from the return spaces 201, "A", and 220, "B" and seven moves and nine moves from return space 240 "C". Payback spaces are likewise located so that the players' interaction with the Payback instructions may be controlled; however, the players have equal opportunities to interact with both Karma spaces and Payback spaces through the use of a random number generator, such as dice, to determine their movement.

The game thus involves a race among players to achieve a long-range goal and requires the completion of short-term goals. In the game, a player may expedite the completion of the short-term goals but at the expense of the achievement of his long-range goal. The player finds himself in the dilemma often in the game, and its preferred embodiment is designed so that the player must frequently exercise his judgment while confronted with such a dilemma. Although the invention is preferrably described as a Karma board game, its concepts may be embodied with other themes and in other forms in accordance with the claims.

What is claimed is:

1. A game involving the concepts of Karma for the entertainment of two or more persons comprising:

currency, a set of dice, a marker for each person, a board having a closed circuit made up of a plurality of adjacent, indicia-bearing spaces arranged seriatim, said closed circuit being divided into two or more sections, each section including a portion of the spaces and indicia to represent a span of life, and ending with a barrier space and beginning with a return space and including intermediate spaces with indicia defining a Karma space corresponding to Karma collection cards and a payback space corresponding to Karma payback cards, a number of Good Karma chips, a number of Bad Karma chips, two sets of Karma collection cards, one set of Bad Karma cards bearing indicia correlated to currency and a Bad Karma chip and the other set of Good Karma cards bearing indicia correlated to currency and a Good Karma chip, two sets of Karma payback cards, one set of Bad Karma payback cards bearing indicia correlated to currency and the other set of Good Karma payback cards bearing indicia correlated to currency, said barrier space bearing indicia of an amount of currency and the associated return space, said game being played by a process in which each player in turn throws the dice and moves his marker from space to space on the closed circuit the number of spaces corresponding to the number on the dice after each throw, follows indicia on the space where his marker comes to rest and, if the space is a Karma space, chooses either a Good Karma card or a Bad Karma card and, if the space is a payback space, chooses either a Good Karma payback card or a Bad Karma payback card, expends Good or Bad Karma chips and either receives or expends currency in compliance with the indicia provided on each space on which his marker comes to rest or on the Good and Bad Karma cards or the Good and Bad Karma payback cards, and stops at each barrier space, expending the amount of currency required at each barrier, if possible, before proceeding on and if not possible, returning his token to the return space, the game involving a race between the players to complete a number of transits of the closed circuit and to dispose of all Bad Karma chips.

2. The game of claim 1 wherein it is favorable to retain Good Karma chips for use after the required number of transits of the closed circuit.

3. The game of claim 1 wherein the closed circuit is arranged about the edge of a square board, with forty-eight spaces in four sections, one section along each edge of the board, and with the corners of the board comprising spaces including a start-finish space and three barrier spaces, one at the end of each of the first three sections, and wherein the space next to each corner space is a return space, and the Karma spaces and payback spaces are located a number of spaces from the return space in each section such that the probability of the numbers obtainable in operation of the dice are such that a marker leaving the return space is more likely to come to rest at Karma and payback spaces than other spaces in the section.

4. A game for the entertainment of two or more persons comprising:

a medium of exchange, a pair of dice, a marker for each person, first and second decks of indicia-bearing collection cards, third and fourth decks of indicia-bearing payback cards, and a board having a closed circuit made up of a plurality of adjacent spaces arranged seriatim and including decision spaces of two different kinds, the first decision spaces bearing indicia correlated to both the first and the second decks of cards, and the second decision spaces bearing indicia correlated to both the third and fourth decks of cards, the closed circuit being arranged about the edge of a square board, with forty-eight spaces in four sections, one section along each edge of the board, and with the corners of the board comprising spaces bearing indicia defining a start-finish space and three barrier spaces, one at the end of each of the first three sections, and with the space next to each corner space at the beginning of each section defining a return space, the first two sections including first decision spaces located seven spaces and ten spaces from the return space and including second decision spaces located six spaces and nine spaces from the return space, the third section including first decision spaces located seven spaces and nine spaces from the return space and including second decision spaces located six spaces and ten spaces from the return space.

5. The game of claim 4 including:

said medium of exchange being currency, a number of good future counters, a number of bad future counters, the first deck of collection cards including indicia correlated to currency and a bad future counter, and the second deck of collection cards including indicia correlated to currency and a good future counter, the third deck of payback cards including indicia correlated to currency, and the fourth deck of payback cards including indicia correlated to currency.

6. A game for the entertainment of two or more players comprising:

a medium of exchange, a controlled probability random number generator, a marker for each player, two sets of future collection cards, two sets of future payback cards, a board having a closed circuit made up of a plurality of adjacent spaces arranged seriatim, said closed circuit being divided into two or more sections, each section including a portion of the spaces, and ending with a barrier space and beginning with a return space and with the spaces between the return space and barrier space being correlated to the medium of exchange and the four cards, said barrier spaces having indicia corresponding to an amount of medium of exchange and the return space at the beginning of that section, each section having two different decision spaces, the first decision space bearing indicia correlated to the sets of future collection cards and the second decision space bearing indicia correlated to the sets of future payback cards, the location of the first decision space and second decision space from the return space in each section and the probability of the numbers obtainable in operation of the controlled probability number generator being such that a marker leaving a return space is more likely to come to rest at first decision and second decision spaces than other spaces in the section.

7. The game of claim 6 in which the closed circuit is arranged about the edge of a square board, with forty-eight spaces in four sections, one along each edge of the board, and with the corners of the board comprising spaces including a start-finish space and three barrier spaces, one at the end of each of the first three sections, and the space next to each corner space is a return space; in which the controlled probability random number generator is a pair of dice; and in which the first two sections include first decision spaces located seven spaces and ten spaces from the return space and include second decision spaces located six spaces and nine spaces from the return space and in which the third section includes first decision spaces located seven spaces and nine spaces from the return space and includes second decision spaces located six spaces and ten spaces from the return space.

8. The game of claim 6 including said medium of exchange being currency, one set of good future counters and one set of bad future counters, one set of future collection cards carrying indicia correlated to currency and a bad future counter and the other set of future collection cards carrying indicia correlated to currency and a good future counter, one set of future payback cards carrying indicia correlated to currency and the other set of future payback cards carrying indicia correlated to currency, and at least a portion of the spaces of the closed circuit bearing indicia corresponding to currency and the movement of a marker.

9. A game and board having a playing area which has a plurality of adjacent marker positions for random number progression of a marker, comprising a starting position for beginning play;

a plurality of intermediate play positions;

a random number generator to provide for movement of a marker;

one or more barrier positions past which a marker may not proceed unless certain conditions are met, and if said conditions are not met, the marker will be returned to a preceding position;

a first deck of collection cards;

a second deck of collection cards;

a third deck of payback cards;

a fourth deck of payback cards;

a first indicia on a plurality of said intermediate play positions correlated to said first deck of cards and said second deck of cards; and a second indicia on a plurality of said intermediate play positions correlated to said third deck of cards and said fourth deck of cards;

a set of first counters, said first counters being correlated to said first deck of cards, and said fourth deck of cards; and a set of second counters said second counters being correlated to said second deck of cards, and said third deck of cards.

10. The game of claim 9 wherein each of said first deck of cards has indicia on its back correlated to the first counters and each of said second deck of cards has indicia on its back correlated to the second counters.

11. A game, comprising a playing board having a closed circuit comprised of a starting position for beginning; a plurality of adjacent marker positions with varying indicia instructing player activity, the marker positions being accessible by means of a random number generator means;

a first deck of collection cards;

a second deck of collection cards;

a third deck of payback cards;

a fourth deck of payback cards;

a first indicia on a plurality of said marker positions correlated to both said first deck of cards and said second deck of cards;

a second indicia on a plurality of said marker positions correlated to both said third deck of cards and said fourth deck of cards;

a set of first counters representing long-term advantage, said first counters being correlated to said first cards, and said fourth cards;

a set of second counters representing long-term disadvantage, said second counters being correlated said second cards, and said third cards;

currency, to be received and dispersed according to the varying indicia on said closed circuit and on said cards; and one or more of said marker positions constitutes a barrier position correlated to a prior associated marker position.

* * * * *

UNITED STATES PATENT AND TRADEMARK OFFICE

CERTIFICATE OF CORRECTION

PATENT NO. : 4,359,226

DATED : November 16, 1982

INVENTOR(S) : Robert A. Neff

It is certified that error appears in the above-identified patent and that said Letters Patent is hereby corrected as shown below:

Column 6, line 45, a subparagraph should begin at "145--RECEIVE $20 FOR THE SALE OF STOLEN HUBCAPS."; line 52, "OR should read -- OF --; line 55, "TURH" should read -- TURN --.

Column 13; claim 6, line 15, after "four" insert -- sets of --.

Column 14, claim 11, line 22, after "correlated" and before the second occurrence of "said", insert -- to --.

Signed and Sealed this

Seventh Day of June 1983

[SEAL]

Attest:

DONALD J. QUIGG

Attesting Officer

Acting Commissioner of Patents and Trademarks